US011150578B2

(12) United States Patent
Wada et al.

(10) Patent No.: US 11,150,578 B2
(45) Date of Patent: Oct. 19, 2021

(54) DEVELOPING DEVICE HAVING AIR DISCHARGE DUCT AND IMAGE FORMING APPARATUS INCLUDING THE DEVELOPING DEVICE

(71) Applicant: KYOCERA Document Solutions Inc., Osaka (JP)

(72) Inventors: Minoru Wada, Osaka (JP); Yuji Kamiyama, Osaka (JP); Ikuo Makie, Osaka (JP); Yu Sasaki, Osaka (JP); Yukari Ota, Osaka (JP); Ryo Yamada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/995,574

(22) Filed: Aug. 17, 2020

(65) Prior Publication Data

US 2021/0055674 A1 Feb. 25, 2021

(30) Foreign Application Priority Data

Aug. 21, 2019 (JP) ..... JP2019-151400
Aug. 21, 2019 (JP) ..... JP2019-151409

(51) Int. Cl.
*G03G 15/08* (2006.01)
*G03G 21/20* (2006.01)

(52) U.S. Cl.
CPC ..... *G03G 15/0891* (2013.01); *G03G 15/0889* (2013.01); *G03G 15/0893* (2013.01); *G03G 21/206* (2013.01)

(58) Field of Classification Search
CPC ..... G03G 15/0891; G03G 15/0889; G03G 21/206; G03G 15/0893; G03G 2221/1645
See application file for complete search history.

(56) References Cited

U.S. PATENT DOCUMENTS 4,377,334 A * 3/1983 Nishikawa ..... G03G 15/0942 399/103
6,125,244 A * 9/2000 Kamiya ..... G03G 15/6558 399/388
7,187,892 B2 * 3/2007 Horike ..... G03G 15/0818 399/252

(Continued)

FOREIGN PATENT DOCUMENTS

JP 2017-21280 A 1/2017

*Primary Examiner* — Walter L Lindsay, Jr.
*Assistant Examiner* — Laura Roth
(74) *Attorney, Agent, or Firm* — Stein IP, LLC

(57) ABSTRACT

A developing device includes a developing container, a first stirring member and a second stirring member, and a developing roller. The developing container includes a first stirring chamber, a second stirring chamber, and a communication portion. The first stirring member includes a reverse spiral vane that conveys a developer in a direction reverse to a circulation direction. An air discharge duct is formed on a wall portion of the first stirring chamber opposed to the reverse spiral vane and in an area excluding the communication portion and discharges air from the first stirring chamber to an outside of the developing container via an air discharge port at a distal end of the air discharge duct. A filtration portion is disposed in the air discharge duct adjacently to the air discharge port and restricts leakage of the developer through the air discharge port.

6 Claims, 5 Drawing Sheets

(56) References Cited

U.S. PATENT DOCUMENTS

| | | | | |
|---|---|---|---|---|
| 2008/0063425 | A1* | 3/2008 | Idehara | G03G 21/1857 399/93 |
| 2009/0162106 | A1* | 6/2009 | Hattori | G03G 15/0818 399/261 |
| 2014/0205311 | A1* | 7/2014 | Kashimoto | G03G 15/0898 399/98 |
| 2014/0348543 | A1* | 11/2014 | Kashimoto | G03G 15/0893 399/257 |
| 2020/0192247 | A1* | 6/2020 | Park | G03G 15/0893 |

* cited by examiner

DEVELOPING DEVICE HAVING AIR DISCHARGE DUCT AND IMAGE FORMING APPARATUS INCLUDING THE DEVELOPING DEVICE

INCORPORATION BY REFERENCE

This application is based upon and claims the benefit of priority from the corresponding Japanese Patent Application No. 2019-151400 (filed on Aug. 21, 2019) and Japanese Patent Application No. 2019-151409 (filed on Aug. 21, 2019), the contents of which are incorporated herein by reference.

BACKGROUND

The present disclosure relates to a developing device and an image forming apparatus including the same.

In an image forming apparatus adopting an electrophotographic method, such as a copy machine or a printer, there is widely used a device that causes toner to adhere to an electrostatic latent image formed on a surface of an image carrier such as a photosensitive drum and develops the electrostatic latent image so as to form a toner image to be transferred later to a sheet. In such a developing device, a developer including toner, which is contained inside a developing container, is conveyed while being stirred inside the developing container so that uniform images are formed in a continuous manner.

In the developing device, a developing roller and a stirring member are caused to rotate to suck air from an outside into the developing container, so that an air pressure in the developing container may be increased. This increase in air pressure in the developing container has been problematic in that the developer might scatter from an inside to the outside of the developing container. There are known conventional techniques aimed to solve this kind of trouble.

For example, in a developing device of a conventional image forming apparatus, a developing roller is disposed in an upper part in a housing (a developing container) and a stirring screw is disposed in a lower part in the housing. On a cover disposed on an upper surface of the housing, a communication port is formed in a region opposite via the developing roller to a developing region in which the developing roller is opposed to a photosensitive drum. Being open upward, the communication port establishes communication between an inside and an outside of the housing and is covered with a filter. Thus, it is possible to prevent leakage of toner, while suppressing an increase in air pressure inside the developing device.

SUMMARY

A developing device according to a first aspect of the present disclosure includes a developing container, a first stirring member and a second stirring member, and a developer carrier. The developing container includes a first stirring chamber and a second stirring chamber that are divided from each other with a partition and disposed in parallel with each other and a communication portion that establishes communication between the first stirring chamber and the second stirring chamber on each of both longitudinal end sides of the first stirring chamber and the second stirring chamber, the developing container containing a developer including toner to be supplied to an image carrier. The first stirring member and the second stirring member are rotatably supported inside the first stirring chamber and the second stirring chamber, respectively, and convey, while stirring, the developer in opposite directions to each other along rotational axis directions thereof so that the developer circulates in a prescribed circulation direction. The developer carrier is rotatably supported to the developing container so as to be opposed to the image carrier, carries the toner in the second stirring chamber, and supplies the toner to the image carrier. The first stirring member includes a forward spiral vane that conveys the developer in the circulation direction and a reverse spiral vane that is provided in a vicinity of the communication portion provided at a downstream end in the circulation direction and conveys the developer in a direction reverse to the circulation direction. The developing device further includes an air discharge duct and a filtration portion. The air discharge duct is formed on a wall portion of the first stirring chamber opposed to the reverse spiral vane and in an area excluding the communication portion and discharges air from the first stirring chamber to an outside of the developing container via an air discharge port that is open at a distal end of the air discharge duct. The filtration portion is disposed in the air discharge duct adjacently to the air discharge port and restricts leakage of the developer through the air discharge port.

A developing device according to a second aspect of the present disclosure includes a developing container, a developer carrier, and a restriction blade. The developing container contains a developer including toner to be supplied to an image carrier. The developer carrier is rotatably supported to the developing container and supplies, in a developing region opposed to the image carrier, the toner in the developing container to the image carrier. The restriction blade is disposed, in the developing region, on an upstream side in a rotation direction of the developer carrier and restricts a layer thickness of the developer carried by the developer carrier. The developing device further includes an air discharge portion and a filtration portion. The air discharge portion is formed between a side surface of the restriction blade on the upstream side in the rotation direction of the developer carrier and a wall portion of the developing container opposed to said side surface and discharges air from an inside to an outside of the developing container via an air discharge port that is open at a distal end of the air discharge portion. The filtration portion is disposed in the air discharge portion adjacently to the air discharge port and restricts leakage of the developer through the air discharge port.

DETAILED DESCRIPTION

With reference to the appended drawings, the following describes embodiments of the present disclosure. The present disclosure, however, is not limited to the following description.

Figure 1:
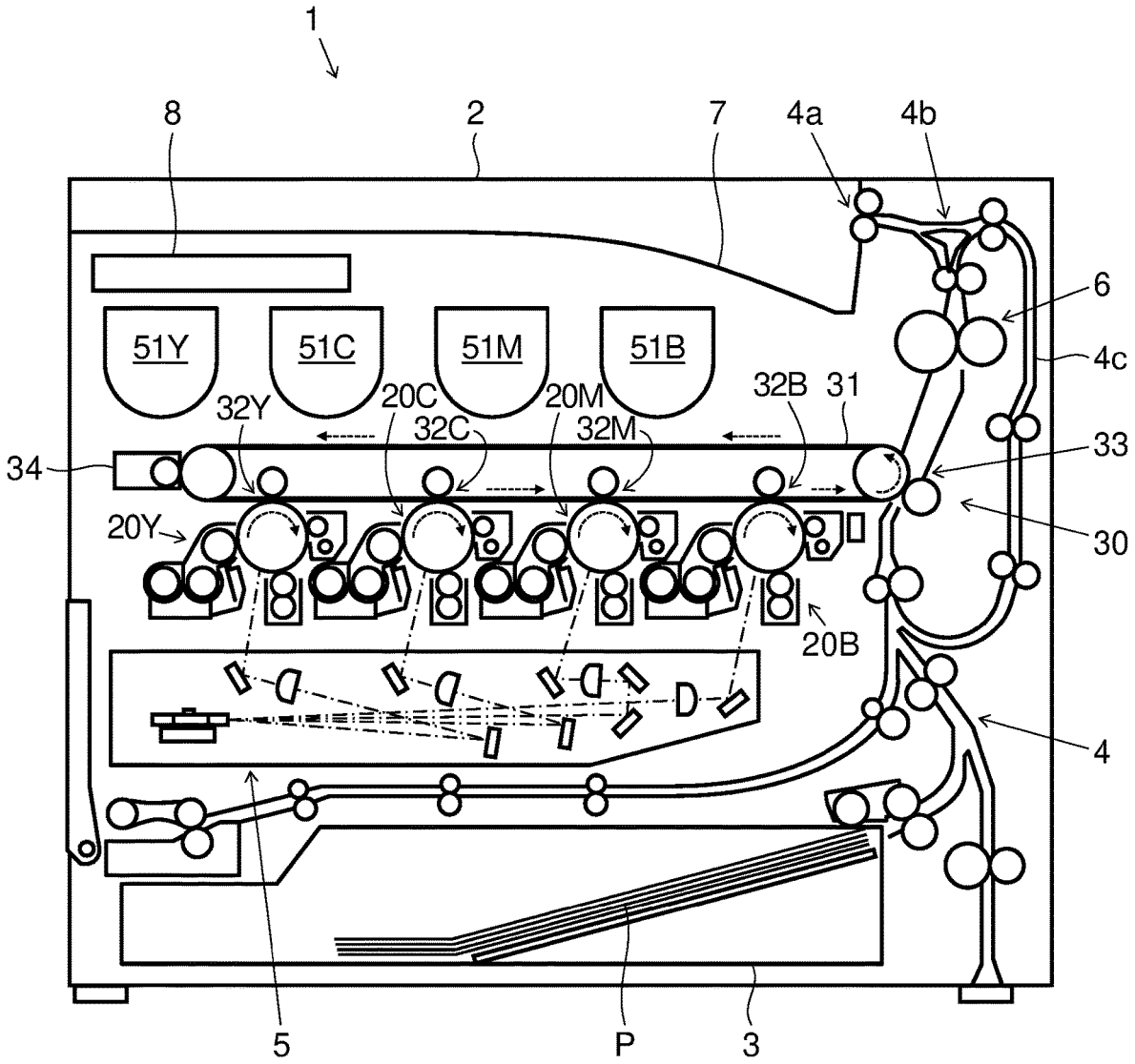
FIG. 1 is a schematic sectional view showing a configuration of an image forming apparatus according to an embodiment of the present disclosure.
Figure 2:
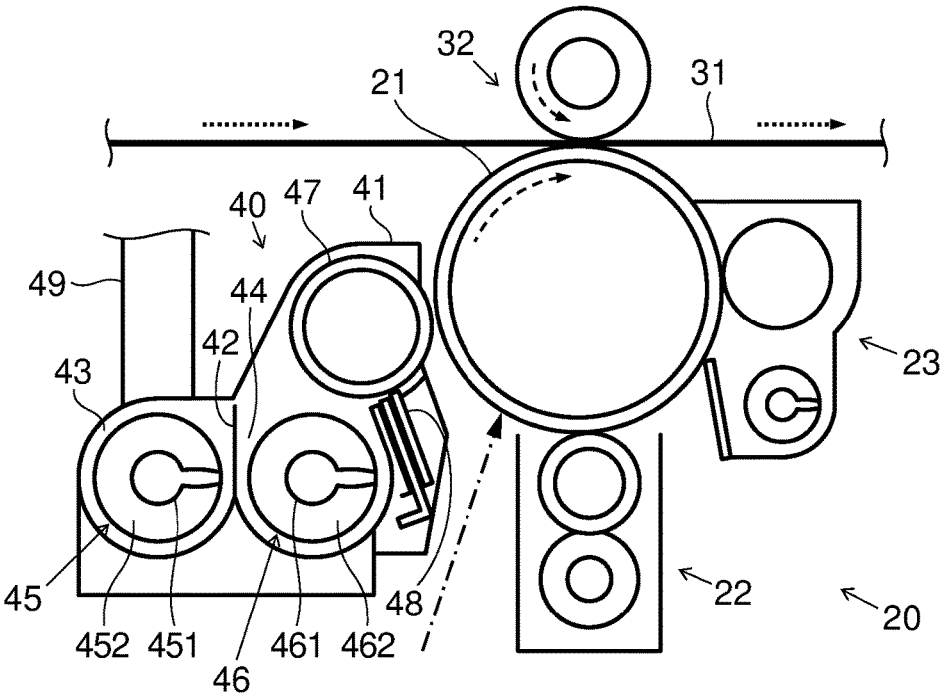
FIG. 2 is a vertical sectional view of an image forming portion of the image forming apparatus according to the embodiment of the present disclosure.

FIG. 1 is a schematic sectional view showing a configuration of an image forming apparatus 1 according to an embodiment. FIG. 2 is a vertical sectional view showing an image forming portion 20 of the image forming apparatus 1. One example of the image forming apparatus 1 according to this embodiment is a tandem-type color printer that transfers a toner image to a sheet P by use of an intermediate transfer belt 31. The image forming apparatus 1 may be a so-called multi-functional peripheral that is equipped with functions such as, for example, printing, scanning (image reading), and facsimile transmission.

As shown in FIG. 1 and FIG. 2, the image forming apparatus 1 includes a paper feed portion 3, a sheet conveyance portion 4, an exposure portion 5, an image forming portion 20, a transfer portion 30, a fixing portion 6, a sheet discharge portion 7, and a control portion 8, which are provided in a main body 2 thereof.

The paper feed portion 3 houses a plurality of sheets P and feeds them out one by one separately during printing. The sheet conveyance portion 4 conveys a sheet P, among the plurality of sheets P, fed out from the paper feed portion 3 to a secondary transfer portion 33 and the fixing portion 6 and further discharges the sheet P that has been subjected to fixing to the sheet discharge portion 7 through a sheet discharge port 4*a*. In a case of performing double-sided printing, the sheet conveyance portion 4 sorts, by use of a branch portion 4*b*, the sheet P whose first side has been subjected to fixing into an inverse conveyance portion 4*c* so as to convey the sheet P again to the secondary transfer portion 33 and the fixing portion 6. The exposure portion 5 applies laser light controlled based on image data towards the image forming portion 20.

The image forming portion 20 is disposed below the intermediate transfer belt 31. The image forming portion 20 includes an image forming portion 20Y for yellow, an image forming portion 20C for cyan, an image forming portion 20M for magenta, and an image forming portion 20B for black. These four image forming portions 20 have an identical basic configuration. In the following description, identification symbols "Y," "C," "M," and "B" representing the respective colors, therefore, may be omitted unless there is a particular need for limitation.

The image forming portion 20 includes a photosensitive drum (an image carrier) 21 supported so as to be rotatable in a prescribed direction (clockwise in FIG. 1 and FIG. 2). The image forming portion 20 further includes a charging portion 22, a developing device 40, and a drum cleaning portion 23 that are disposed around the photosensitive drum 21 along a rotation direction thereof. A primary transfer portion 32 is disposed between the developing device 40 and the drum cleaning portion 23.

The charging portion 22 charges a surface of the photosensitive drum 21 to a prescribed potential. Then, on the surface of the photosensitive drum 21, an electrostatic latent image of an original document image is formed by laser light applied from the exposure portion 5. The developing device 40 causes toner to adhere to the electrostatic latent image so as to develop the electrostatic latent image into a toner image. The four image forming portions 20 form toner images of different colors from each other.

The transfer portion 30 includes the intermediate transfer belt 31, primary transfer portions 32Y, 32C, 32M, and 32B, the secondary transfer portion 33, and a belt cleaning portion 34. The intermediate transfer belt 31 is disposed above the four image forming portions 20. The intermediate transfer belt 31 is supported so as to be rotatable in a prescribed direction (counterclockwise in FIG. 1) and is an intermediate transfer member to which toner images formed respectively in the four image forming portions 20 are primarily transferred in a sequentially superimposed manner. The four image forming portions 20 are disposed in a so-called tandem arrangement in which they are arranged in a row from an upstream side toward a downstream side in a rotation direction of the intermediate transfer belt 31.

The primary transfer portions 32Y, 32C, 32M, and 32B are disposed above the image forming portions 20Y, 20C, 20M, and 20B of the respective colors, respectively, via the intermediate transfer belt 31. The secondary transfer portion 33 is disposed on an upstream side of the fixing portion 6 in a sheet conveyance direction in the sheet conveyance portion 4 and a downstream side of the image forming portions 20Y, 20C, 20M, and 20B of the respective colors in the rotation direction of the intermediate transfer belt 31 in the transfer portion 30. The belt cleaning portion 34 is disposed on an upstream side of the image forming portions 20Y, 20C, 20M, and 20B of the respective colors in the rotation direction of the intermediate transfer belt 31.

In the primary transfer portions 32Y, 32C, 32M, and 32B of the respective colors, the toner images are primarily transferred to an outer circumferential surface of the intermediate transfer belt 31. Further, as the intermediate transfer belt 31 rotates, the toner images formed respectively by the four image forming portions 20 are transferred at prescribed timing to the intermediate transfer belt 31 in a successively superimposed manner, and thus a color toner image of superimposed toner images of the four colors of yellow, cyan, magenta, and black is formed on the outer circumferential surface of the intermediate transfer belt 31. The drum cleaning portion 23 performs cleaning by removing residual toner or the like remaining on the surface of the photosensitive drum 21 after the primary transfer.

In a secondary transfer nip portion formed in the secondary transfer portion 33, the color toner image on the outer circumferential surface of the intermediate transfer belt 31 is transferred to the sheet P conveyed thereto by the sheet conveyance portion 4 so as to be timed with the transfer. The belt cleaning portion 34 performs cleaning by removing residual toner or the like remaining on the surface of the intermediate transfer belt 31 after the secondary transfer.

The fixing portion 6 applies heat and pressure to the sheet P to which the toner image has been transferred, thus fixing the toner image to the sheet P.

The control portion 8 includes a CPU, an image processing portion, a storage portion, and other electronic circuits and electronic components (none of them is shown). Based on a control program or control data stored in the storage portion, the CPU controls operations of various constituent elements provided in the image forming apparatus 1 so as to perform processes related to functions of the image forming apparatus 1. The paper feed portion 3, the sheet conveyance portion 4, the exposure portion 5, the image forming portion 20, the transfer portion 30, and the fixing portion 6 individually receives commands from the control portion 8 and perform printing on the sheet P in conjunction with each other. The storage portion is constituted by, for example, a combination of a non-volatile storage device such as a program ROM (read-only memory) or a data ROM and a volatile storage device such as a RAM (random-access memory).

Figure 3:
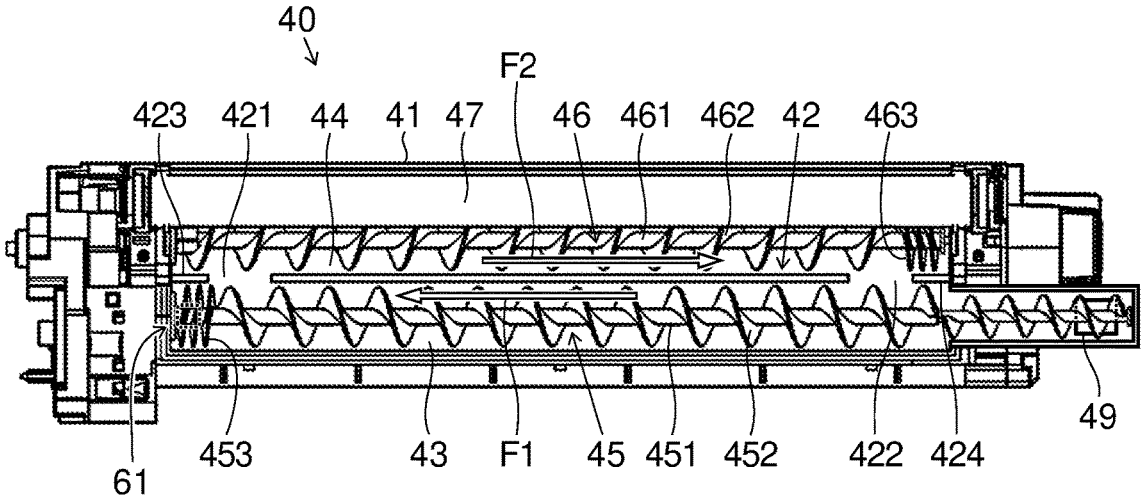
FIG. 3 is a horizontal sectional view of a developing device of the image forming apparatus according to the embodiment of the present disclosure.

Next, a description is given of a configuration of the developing device 40 with reference to FIG. 3 in addition to FIG. 2. FIG. 3 is a horizontal sectional view of the developing device 40. For each of the respective colors, the developing device 40 has an identical basic configuration, and identification symbols representing the respective colors for the constituent elements, therefore, are omitted and not described. Furthermore, in this description, an "axis direction" refers to each of mutually parallel extending rotational axis directions of the photosensitive drum 21, a first stirring member 45, a second stirring member 46, and a developing roller 47 (a depth direction in planes of FIG. 2, FIG. 4, and FIG. 5, a left-right lateral direction in FIG. 3).

The developing device 40 is mountable/demountable with respect to, for example, the main body 2 of the image forming apparatus 1. As shown in FIG. 2 and FIG. 3, the developing device 40 includes a developing container 41, a partition 42, a first stirring chamber 43, a second stirring chamber 44, the first stirring member 45, the second stirring member 46, the developing roller 47, a restriction blade 48, and a developer replenishment duct 49.

The developing container 41 contains, for example, a two-component developer including toner and a magnetic carrier as a developer to be supplied from the developing device 40 to the surface of the photosensitive drum 21. The developing container 41 has an elongated shape extending along the axis direction along which a rotation center of the photosensitive drum 21 extends and is disposed so that a longitudinal direction thereof is horizontal.

The partition 42 is provided in a lower part inside the developing container 41. The partition 42 is provided at substantially a middle of the lower part in the developing container 41 in a direction intersecting with the axis direction (a left-right lateral direction in FIG. 2) and extends in the axis direction and in an up-down direction. The partition 42 divides an inside of the developing container 41 in the direction intersecting with the axis direction.

The first stirring chamber 43 and the second stirring chamber 44 are provided inside the developing container 41. The first stirring chamber 43 and the second stirring chamber 44 are formed by dividing the inside of the developing container 41 with the partition 42 and are disposed in parallel with each other. Inside the developing container 41, the second stirring chamber 44 is disposed below and adjacently to a region in which the developing roller 47 is disposed. Inside the developing container 41, the first stirring chamber 43 is disposed in a region more distant than the second stirring chamber 44 from the developing roller 47. The first stirring chamber 43 is replenished with the developer via the developer replenishment duct 49 shown in FIG. 3.

The partition 42 includes a first communication portion 421 and a second communication portion 422. The first communication portion 421 and the second communication portion 422 are disposed on both end sides of the partition 42 in the axis direction, respectively. The first communication portion 421 and the second communication portion 422 penetrate through the partition 42 on both longitudinal end sides thereof so that the first stirring chamber 43 and the second stirring chamber 44 communicate with each other.

The first stirring member 45 is disposed inside the first stirring chamber 43. The second stirring member 46 is disposed inside the second stirring chamber 44. The first stirring member 45 and the second stirring member 46 are supported to the developing container 41 so as to be rotatable about an axis extending parallel with the photosensitive drum 21.

The first stirring member 45 includes a forward spiral vane 452 provided on an outer circumferential surface of a rotary shaft 451 so as to extend spirally along the axis direction. The forward spiral vane 452 is opposed at both ends thereof in the axis direction to the first communication portion 421 and the second communication portion 422. The second stirring member 46 includes a forward spiral vane 462 provided on an outer circumferential surface of a rotary shaft 461 so as to extend spirally along the axis direction. The forward spiral vane 462 is opposed at both ends thereof in the axis direction to the first communication portion 421 and the second communication portion 422.

The first stirring member 45 and the second stirring member 46 rotate about axes thereof to convey, while stirring, the developer in opposite directions to each other along rotational axis directions thereof so that the developer circulates in a prescribed circulation direction (directions indicated by arrows F1 and F2 in FIG. 3, respectively).

Furthermore, the first stirring member 45 includes a reverse spiral vane 453 provided on the outer circumferential surface of the rotary shaft 451 so as to extend spirally along the axis direction. The reverse spiral vane 453 is provided in a vicinity of the first communication portion 421 so as to be continuous with the forward spiral vane 452 on a downstream end side in the direction F1 of circulation of the developer caused by rotation of the first stirring member 45. A ratio of a length of a part of the first stirring member 45 occupied by the reverse spiral vane 453 to an entire length of the first stirring member 45 in the axis direction is extremely small compared with a ratio of a length of a part of the first stirring member 45 occupied by the forward spiral vane 452 to the entire length of the first stirring member 45 in the axis direction. The reverse spiral vane 453 is formed of a spiral vane having a helical direction reverse (a phase reverse) to that of the forward spiral vane 452. That is, the first stirring member 45 includes the forward spiral vane 452 that conveys the developer in the circulation direction F1 and the reverse spiral vane 453 that is provided in the vicinity of the first communication portion 421 at a downstream end in the circulation direction F1 and conveys the developer in a direction reverse to the circulation direction F1.

Similarly, the second stirring member 46 includes a reverse spiral vane 463 provided on the outer circumferential surface of the rotary shaft 461 so as to extend spirally along the axis direction. The reverse spiral vane 463 is provided in a vicinity of the second communication portion 422 so as to be continuous with the forward spiral vane 462 on a downstream end side in the direction F2 of circulation of the developer caused by rotation of the second stirring member 46. A ratio of a length of a part of the second stirring member 46 occupied by the reverse spiral vane 463 to an entire length of the second stirring member 46 in the axis direction is extremely small compared with a ratio of a length of a part of the second stirring member 46 occupied by the forward spiral vane 462 to the entire length of the second stirring member 46 in the axis direction. The reverse spiral vane 463 is formed of a spiral vane having a helical direction reverse (a phase reverse) to that of the forward spiral vane 462.

The partition 42 includes a first partition wall 423 and a second partition wall 424. The first partition wall 423 is provided on a downstream side of the first communication portion 421 with respect to the circulation direction F1 and opposed to the reverse spiral vane 453. The second partition wall 424 is provided on a downstream side of the second communication portion 422 with respect to the circulation direction F2 and opposed to the reverse spiral vane 463.

Each of the reverse spiral vanes 453 and 463 exerts a conveyance force in a reverse direction on the developer conveyed by a corresponding one of the forward spiral vanes 452 and 462 along a corresponding one of the circulation directions F1 and F2, thus damming up the developer and pushing it back. This suppresses an increase in rotation torque resulting from the entry of the developer into a bearing of the rotary shaft 451 or 461 at a downstream end in a corresponding one of the circulation directions F1 and F2 and solidification of the developer caused by frictional heat. Furthermore, by the conveyance force in a reverse direction exerted by each of the reverse spiral vanes 453 and 463, the developer that has advanced to a neighborhood of a downstream end of a corresponding one of the first stirring chamber 43 and the second stirring chamber 44 in a corresponding one of the circulation directions F1 and F2 is conveyed back toward the first communication portion 421 or the second communication portion 422.

The first stirring member 45 and the second stirring member 46 rotate, and thus the developer circulates between the first stirring chamber 43 and the second stirring chamber 44 by passing through the first communication portion 421 and the second communication portion 422 provided at both ends of the partition 42 in the axis direction, respectively. In each of the first stirring chamber 43 and the second stirring chamber 44, externally replenished toner (positively charged toner) is blended with a magnetic carrier and stirred to be charged.

The developing roller 47 is disposed above the second stirring member 46 inside the developing container 41. The developing roller 47 is supported to the developing container 41 so as to be rotatable about an axis extending parallel with the photosensitive drum 21. The developing roller 47 includes, for example, a cylindrical developing sleeve rotatable counterclockwise in FIG. 2 and a developing roller-side magnetic pole fixed in the developing sleeve (neither of them is shown). A prescribed developing voltage obtained by superimposing an alternating current voltage on a direct current voltage is applied to the developing roller 47. A part of a surface of the developing roller 47 is exposed from the developing container 41 and opposed to the photosensitive drum 21. The developing roller 47 carries the developer in the second stirring chamber 44 and supplies toner to the surface of the photosensitive drum 21 in a developing region opposed to the photosensitive drum 21.

The restriction blade 48 is disposed on an upstream side in a rotation direction of the developing roller 47 in the developing region in which the developing roller 47 and the photosensitive drum 21 are opposed to each other. The restriction blade 48 is disposed in proximity to the developing roller 47 so that a prescribed spacing is provided between a distal end thereof and a surface of the developing roller 47. The restriction blade 48 extends over an entire region of the developing roller 47 in the axis direction. The restriction blade 48 restricts a layer thickness of the developer carried by the developing roller 47, which passes through a gap between the distal end thereof and the surface of the developing roller 47.

The developer is stirred to circulate by each of the first stirring member 45 and the second stirring member 46 in a corresponding one of the first stirring chamber 43 and the second stirring chamber 44 so as to be charged, and then is carried on the surface of the developing roller 47. The layer thickness of the developer carried on the surface of the developing roller 47 is restricted by the restriction blade 48. An unshown magnetic brush composed of toner and a magnetic carrier is formed on the surface of the developing roller 47. When a prescribed developing voltage is applied to the developing roller 47, due to a potential difference between a potential of the thus applied developing voltage and a surface potential of the photosensitive drum 21, the toner carried on the surface of the developing roller 47 flies to the surface of the photosensitive drum 21 in the developing region, thus developing an electrostatic latent image on the surface of the photosensitive drum 21.

In the developing container 41, the developer replenishment duct 49 is disposed on one end side of the developing roller 47 in the axis direction and extends in the up-down direction (see FIG. 2). A lower end of the developer replenishment duct 49 is positioned on an outer side of the first stirring chamber 43 in the axis direction and communicates with the first stirring chamber 43. The first stirring member 45 extends to a lower part of the developer replenishment duct 49. An upper end of the developer replenishment duct 49 is connected to a developer conveyance portion (not shown) provided in the main body 2 of the image forming apparatus 1.

In relation to replenishing the developing device 40 with the developer, the image forming apparatus 1 includes a container 51 shown in FIG. 1 and the developer conveyance portion. The container 51 and the developer conveyance portion are both disposed above the developing device 40. Four containers 51 and four developer conveyance portions are provided so as to correspond to four colors of yellow, cyan, magenta, and black, respectively. The container 51 contains the developer to be replenished to the developing device 40 and is mountable/demountable with respect to the developer conveyance portion. The developer contained in the container 51 is replenished to the first stirring chamber 43 of the developing container 41 via the developer conveyance portion and the developer replenishment duct 49.

Figure 4:
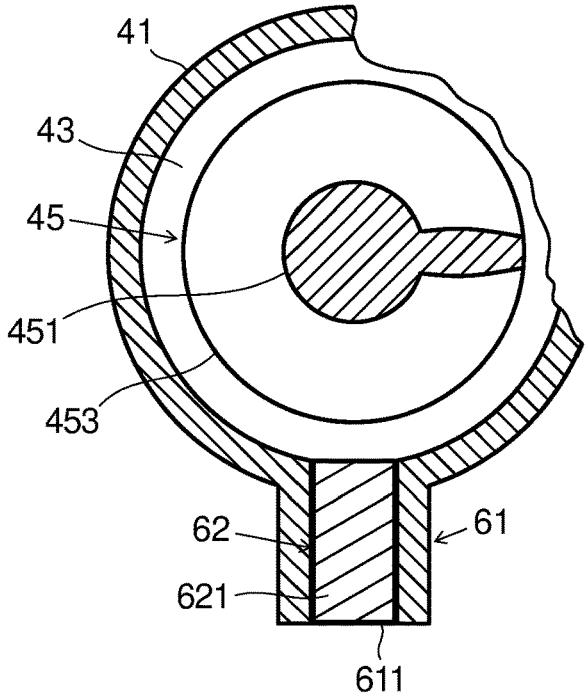
FIG. 4 is a vertical sectional view showing surroundings of an air discharge duct of a developing device according to a first embodiment of the present disclosure.

FIG. 4 is a vertical sectional view showing surroundings of an air discharge duct 61 of a developing device 40 according to a first embodiment. For example, the developing device 40 according to the first embodiment includes the air discharge duct 61 shown in FIG. 3 and a filtration portion 62 shown in FIG. 4.

As shown in FIG. 3, the air discharge duct 61 is formed on a wall portion of the first stirring chamber 43 opposed to the reverse spiral vane 453 and in an area excluding the first communication portion 421. The air discharge duct 61 is formed, for example, at a bottom of the first stirring chamber 43.

The air discharge duct 61 extends downward from the bottom of the first stirring chamber 43. The air discharge duct 61 has an air discharge port 611 open at a lower end as a distal end thereof. The air discharge duct 61 discharges air from the first stirring chamber 43 to an outside of the developing container 41 via the air discharge port 611 open at the distal end thereof.

The filtration portion 62 is disposed in the air discharge duct 61 adjacently to the air discharge port 611. The filtration portion 62 is disposed on an upstream side of the air discharge port 611 with respect to an air flow direction in the air discharge duct 61. The filtration portion 62 permits only air to flow therethrough and restricts passage of the developer therethrough. That is, the filtration portion 62 restricts leakage of the developer through the air discharge port 611.

According to the above-described configuration, the air discharge duct 61 for suppressing an increase in air pressure in the developing container 41 is formed on a most downstream side in a circulation path of the developer with respect to a region in which the developing roller 47 and the second stirring member 46 are opposed to each other. Moreover, the air discharge duct 61 is disposed in a region of the first stirring chamber 43 in which no developer is present as a result of rotation of the reverse spiral vane 453. Accordingly, the air discharge duct 61 can be provided in a region distant from where there is much floating toner peeled off from the developing roller 47 during a developing operation, in which no circulating developer is present, and thus leakage of the developer through the air discharge port 611 can be effectively restricted even when a less costly filter (filtration portion) is used. Thus, it is possible to suppress scattering of the developer to the outside of the developing container 41 by use of a configuration suppressing a cost increase.

Furthermore, according to the above-described configuration, the air discharge duct 61 is formed at the bottom of the first stirring chamber 43. Thus, the air discharge duct 61 can be provided in an area most distant from where there is much floating toner peeled off from the developing roller 47 during a developing operation. Accordingly, it is possible to enhance an effect of suppressing scattering of the developer to the outside of the developing container 41 resulting form an increase in air pressure in the developing container 41. The air discharge duct 61 may be formed on a side wall portion of the first stirring chamber 43.

Furthermore, according to the above-described configuration, the partition 42 includes the first partition wall 423 that is provided on a downstream side of the first communication portion 421 with respect to the circulation direction F1 and opposed to the reverse spiral vane 453 and the second partition wall 424 that is provided on a downstream side of the second communication portion 422 with respect to the circulation direction F2 and opposed to the reverse spiral vane 463. Thus, it is possible to create a state where no developer is present in spaces in which the reverse spiral vanes 453 and 463 are present, respectively. Moreover, it is possible to prevent backflow of the developer from a downstream side to an upstream side with respect to the circulation direction of the developer in each of the first communication portion 421 and the second communication portion 422. Accordingly, it is possible to create a state where the developer is unlikely to enter the air discharge duct 61. This can enhance an effect of restricting leakage of the developer through the air discharge port 611.

The filtration portion 62 includes a filter member 621 that covers the air discharge port 611. The filter member 621 is formed of, for example, urethane and filled over an entire region in the air discharge duct 61 in a direction intersecting with the air flow direction therein. This configuration makes it possible to effectively suppress a cost increase.

Further, more preferably, the filter member 621 has an open cell structure. This configuration can provide improved air flow performance.

Figure 5:
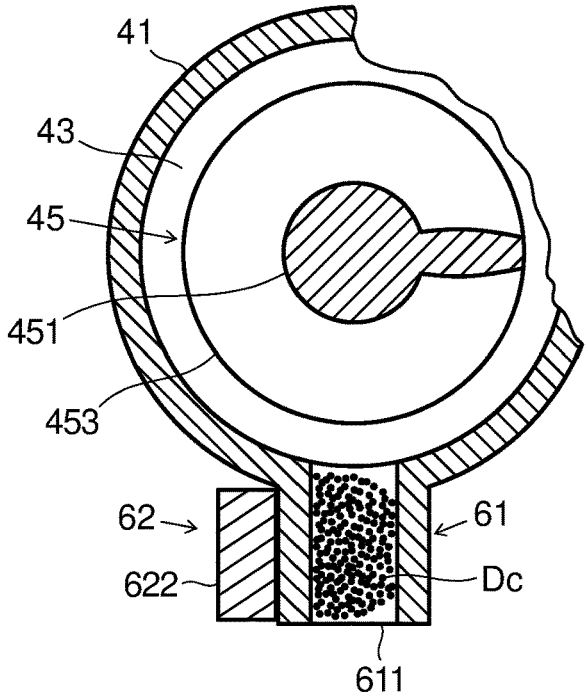
FIG. 5 is a vertical sectional view showing surroundings of an air discharge duct of a developing device according to a second embodiment of the present disclosure.

FIG. 5 is a vertical sectional view showing surroundings of an air discharge duct 61 of a developing device 40 according to a second embodiment. The second embodiment is identical in basic configuration to the first embodiment described earlier, and thus constituent elements in common may be denoted by identical reference characters and referred to identically, with duplicate descriptions thereof omitted and configurations other than characterizing parts not described.

The developing device 40 according to the second embodiment includes the air discharge duct 61 shown in FIG. 5. The air discharge duct 61 is formed at a bottom of a first stirring chamber 43 so as to extend downward. The air discharge duct 61 has an air discharge port 611 open at a lower end as a distal end thereof.

A filtration portion 62 includes a magnet 622. The magnet 622 is disposed in a vicinity of the air discharge port 611 and on an outer side of the air discharge duct 61. The magnet 622 is configured in a shape extending in the up-down direction along an extending direction of the air discharge duct 61.

A developer includes either one of toner and a carrier that have magnetism. In this embodiment, as a developer to be supplied from the developing device 40 to a surface of a photosensitive drum 21, a two-component developer including toner and a magnetic carrier Dc. A one-component developer including magnetic toner may also be used.

According to a configuration of the second embodiment, the filtration portion 62 uses the magnet 622 disposed in the vicinity of the air discharge port 611 to attract the developer (the magnetic carrier Dc) so as to retain the developer in the air discharge duct 61. In the air discharge duct 61, the magnetic carrier Dc is filled over an entire region in a direction intersecting with an air flow direction therein. Thus, the filtration portion 62 restricts leakage of the developer through the air discharge port 611. Accordingly, without the need to use a filter member, it is possible to restrict leakage of the developer through the air discharge port 611 while suppressing an increase in air pressure in the developing container 41.

Figure 6:
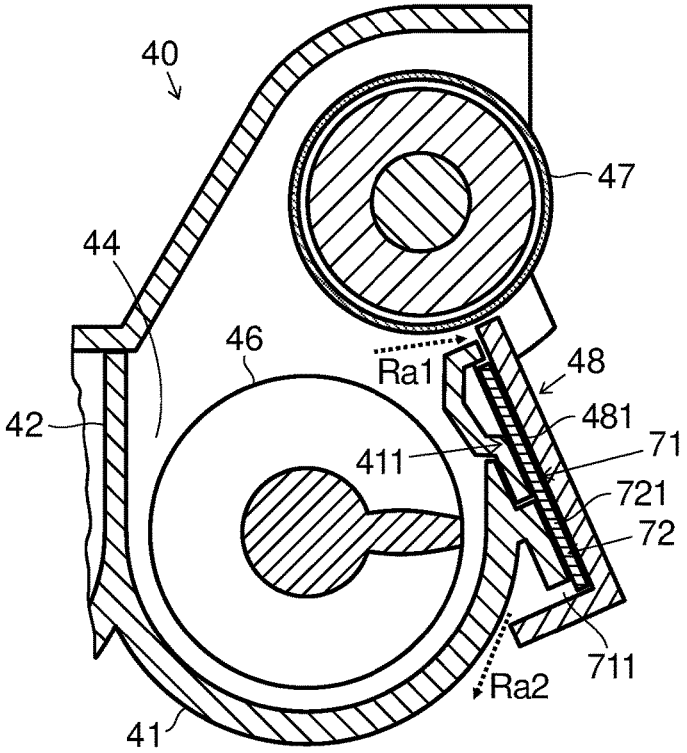
FIG. 6 is a vertical sectional view showing surroundings of an air discharge portion of a developing device according to a third embodiment of the present disclosure.

FIG. 6 is a vertical sectional view showing surroundings of an air discharge portion 71 of a developing device 40 according to a third embodiment. The third embodiment is identical in basic configuration to the first embodiment described earlier, and thus constituent elements in common may be denoted by identical reference characters and referred to identically, with duplicate descriptions thereof omitted and configurations other than characterizing parts not described.

The developing device 40 according to the third embodiment includes the air discharge portion 71 and a filtration portion 72 shown in FIG. 6.

The air discharge portion 71 is formed between a side surface 481 of a restriction blade 48 on an upstream side in a rotation direction of a developing roller 47 and a wall portion 411 of a developing container 41 opposed to said side surface 481. In an axis direction of the developing roller 47, the air discharge portion 71 extends over an entire region of the side surface 481 of the restriction blade 48. In a direction intersecting with the axis direction of the developing roller 47, the air discharge portion 71 extends in such a direction as to approach or separate from the developing roller 47 along the side surface 481 of the restriction blade 48, i.e., from an inner side toward an outer side of the developing container 41.

The air discharge portion 71 has an air discharge port 711 open at a lower end as a distal end thereof distant from the developing roller 47. The air discharge portion 71 discharges air from an inside to an outside of the developing container 41 via the air discharge port 711 open at the distal end. Air flows through the air discharge portion 71 after entering the air discharge portion 71 along an arrow Ra1 shown in FIG. 6 and is discharged through the air discharge port 711 to be conveyed to an outside of the developing device 40 along an arrow Ra2.

The filtration portion 72 is disposed in the air discharge portion 71 adjacently to the air discharge port 711. The filtration portion 72 is disposed on an upstream side of the air discharge port 711 with respect to an air flow direction in the air discharge portion 71. The filtration portion 72 permits only air to flow therethrough and restricts passage of a developer therethrough. That is, the filtration portion 72 restricts leakage of the developer through the air discharge port 711.

According to a configuration of the third embodiment, the air discharge portion 71 for suppressing an increase in air pressure in the developing container 41 is formed adjacently to the restriction blade 48. Furthermore, in a region in which a layer thickness of the developer carried by the developing roller 47 is restricted by the restriction blade 48, the developer to be supplied to a photosensitive drum 21 is fed in a large amount, and thus an amount of floating toner is reduced. That is, the air discharge portion 71 can be provided in a region in which an amount of floating toner peeled off from the developing roller 47 during a developing operation is reduced, and thus leakage of the developer through the air discharge port 711 can be effectively restricted even when a less costly filter (filtration portion) is used. Thus, it is possible to suppress scattering of the developer to the outside of the developing container 41 by use of a configuration suppressing a cost increase.

The filtration portion 72 includes a filter member 721 that covers the air discharge port 711. The filter member 721 is formed of, for example, urethane and filled over an entire region in the air discharge portion 71 in a direction intersecting with the air flow direction therein. This configuration makes it possible to effectively suppress a cost increase.

Further, more preferably, the filter member 721 has an open cell structure. This configuration can provide improved air flow performance.

Figure 7:
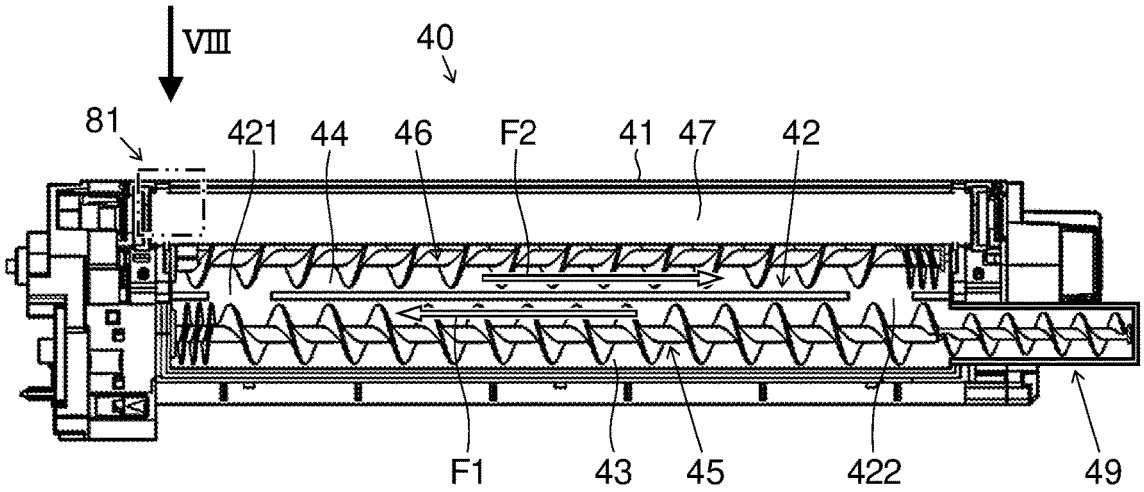
FIG. 7 is a horizontal sectional view of a developing device according to a fourth embodiment of the present disclosure.

FIG. 7 is a horizontal sectional view of a developing device 40 according to a fourth embodiment. The fourth embodiment is identical in basic configuration to the first embodiment described earlier, and thus constituent elements in common may be denoted by identical reference characters and referred to identically, with duplicate descriptions thereof omitted and configurations other than characterizing parts not described.

The developing device 40 according to the fourth embodiment includes an air discharge portion 81 shown in FIG. 7. The air discharge portion 81 is formed on one end side in a rotational axis direction of a developing roller 47. Specifically, the air discharge portion 81 is formed at an upstream end in a direction F2 of conveyance of a developer performed by a second stirring member 46 extending in proximity to and parallel with the developing roller 47.

Figure 8:
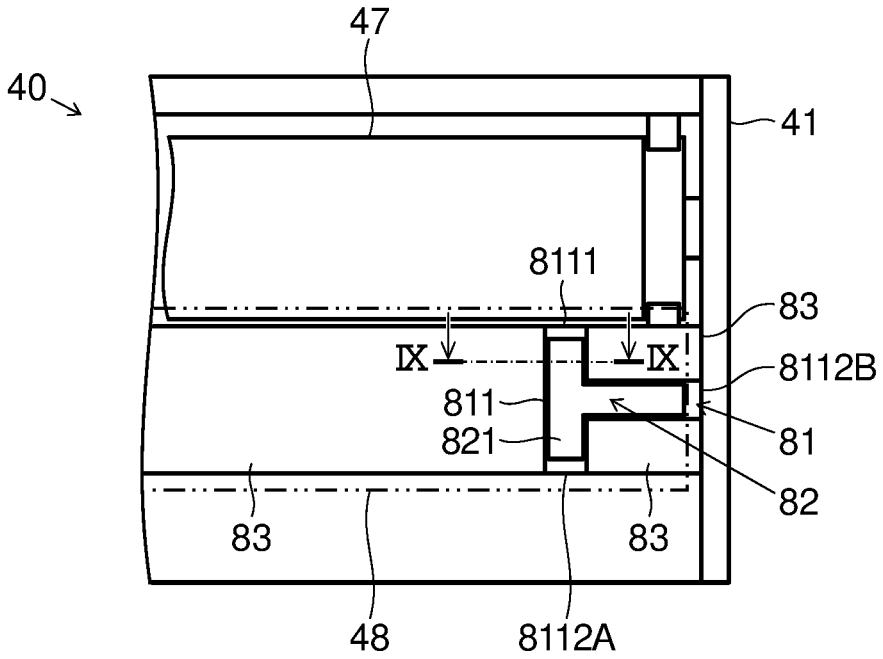
FIG. 8 is a partial side view showing surroundings of an air discharge portion of the developing device according to the fourth embodiment of the present disclosure.
Figure 9:
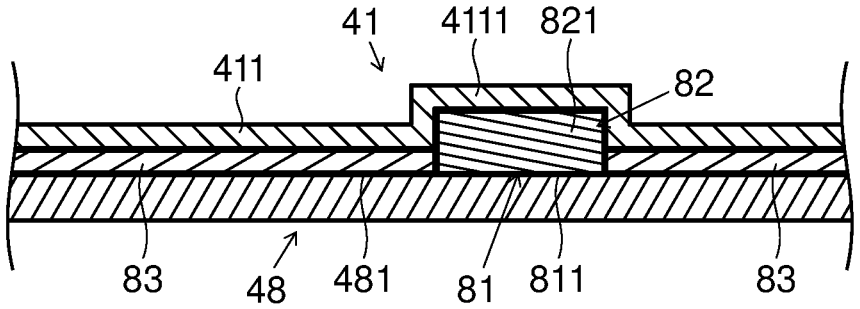
FIG. 9 is a partial horizontal sectional view of the air discharge portion of the developing device according to the fourth embodiment of the present disclosure.

FIG. 8 is a partial side view showing surroundings of the air discharge portion 81 of the developing device 40 according to the fourth embodiment. FIG. 9 is a partial horizontal sectional view of the air discharge portion 81 of the developing device 40 according to the fourth embodiment. FIG. 8 is a schematic external view of a side surface of the developing device 40 as seen from a direction indicated by an arrow VIII shown in FIG. 7 (a direction intersecting with the axis direction of the developing roller 47), which depicts a state where a restriction blade 48 has been removed (as indicated by a chain double-dashed line in FIG. 8). Furthermore, FIG. 9 is a partial horizontal sectional view, as seen from above, of the air discharge portion 81 shown in FIG. 8 along a line IX-IX.

The air discharge portion 81 includes an air discharge duct 811 shown in FIG. 8 and FIG. 9. The air discharge duct 811 is formed so as to be opposed to a part of the developing roller 47 in the rotational axis direction thereof. Specifically, the air discharge duct 811 is formed at an upstream end in the direction F2 of conveyance (see FIG. 7) of the developer performed by the second stirring member 46 so as to be opposed to a part of the developing roller 47 in the axis direction thereof.

The air discharge duct 811 extends from an inner side toward an outer side of a developing container 41 (from an upper side toward a lower side in FIG. 8). Specifically, the air discharge duct 811 extends from an inflow port 8111 provided on the inner side of the developing container 41 to an air discharge port 8112 provided on the outer side of the developing container 41. The air discharge port 8112 includes two air discharge ports 8112A and 8112B. That is, the air discharge duct 811 has the air discharge port 8112 open at a distal end thereof on the outer side of the developing container 41.

As shown in FIG. 8, the air discharge duct 811 according to this embodiment is configured in, for example, a T-shape as seen from the direction intersecting with the axis direction of the developing roller 47. The air discharge duct 811 according to this embodiment includes the single inflow port 8111 and the two air discharge ports 8112A and 8112B. The air discharge port 8112A, which is one of the two air discharge ports 8112A and 8112B, is opposed to the inflow port 8111 along the direction intersecting with the axis direction of the developing roller 47. The air discharge port 8112B, which is the other of the two air discharge ports 8112A and 8112B, is disposed at an extension, along the axis direction of the developing roller 47, of a part of an air flow path extending straight from the inflow port 8111 to the air discharge port 8112A, which is one of the two air discharge ports 8112A and 8112B, the part being obtained by bifurcating the air flow path at a right angle partway along its length. The air discharge duct 811 is not limited in shape to the T-shape and may be in any other shape such as, for example, a linear shape.

As shown in FIG. 9, a wall portion 411 of the developing container 41 opposed to the air discharge duct 811 includes a concave portion 4111. In the wall portion 411, the concave portion 4111 is concaved in such a direction as to separate from the restriction blade 48. The concave portion 4111 is formed in a T-shape along a shape of the air discharge duct 811. That is, the air discharge duct 811 includes an air flow space including an inside space of the concave portion 4111 in addition to a space between a side surface 481 of the restriction blade 48 and the wall portion 411 of the developing container 41.

The developing device 40 further includes a filtration portion 82. The filtration portion 82 is disposed in the air discharge duct 811 adjacently to the air discharge port 8112. The filtration portion 82 is disposed on an upstream side of each of the two air discharge ports 8112 with respect to an air flow direction in the air discharge duct 811. That is, the filtration portion 82 is configured in, for example, a T-shape as seen from the direction intersecting with the axis direction of the developing roller 47. The filtration portion 82 includes a filter member 821 that covers each of the two air discharge ports 8112, permits only air to flow therethrough, and restricts passage of the developer therethrough. That is, the filtration portion 82 restricts leakage of the developer through each of the two air discharge ports 8112.

A seal material 83 is filled in a region excluding the air discharge duct 811 between the side surface 481 of the restriction blade 48 and the wall portion 411 of the developing container 41.

According to a configuration of the fourth embodiment, the air discharge portion 81 for suppressing an increase in air pressure in the developing container 41 can be formed in a configuration further reduced in size. Accordingly, it is possible to create a state where the developer is unlikely to enter the air discharge portion 81. This can enhance an effect of restricting leakage of the developer through the air discharge port 8112.

While the foregoing has described the embodiments of the present disclosure, the scope of the present disclosure is not limited thereto, and the present disclosure can be implemented by adding various modifications thereto without departing from the spirit of the disclosure.

For example, while in the foregoing embodiments, the image forming apparatus 1 is a so-called tandem-type color printing image forming apparatus that forms images of a plurality of colors in a sequentially superimposed manner, there is no limitation to such a type. The image forming apparatus may be a non-tandem-type color printing image forming apparatus or a monochrome printing image forming apparatus.

What is claimed is:

1. A developing device, comprising:

a developing container that includes:

a first stirring chamber and a second stirring chamber that are divided from each other with a partition and disposed in parallel with each other; and a communication portion that establishes communication between the first stirring chamber and the second stirring chamber on each of both longitudinal end sides of the first stirring chamber and the second stirring chamber, the developing container containing a developer including toner to be supplied to an image carrier;

a first stirring member and a second stirring member that are rotatably supported inside the first stirring chamber and the second stirring chamber, respectively, and convey, while stirring, the developer in opposite directions to each other along rotational axis directions thereof so that the developer circulates in a prescribed circulation direction; and a developer carrier that is rotatably supported to the developing container so as to be opposed to the image carrier, carries the toner in the second stirring chamber, and supplies the toner to the image carrier, wherein the first stirring member includes:

a forward spiral vane that conveys the developer in the circulation direction; and a reverse spiral vane that is provided in a vicinity of the communication portion provided at a downstream end in the circulation direction and conveys the developer in a direction reverse to the circulation direction, the developing device further comprises:

an air discharge duct that is formed on a wall portion of the first stirring chamber opposed to the reverse spiral vane and in an area excluding the communication portion and discharges air from the first stirring chamber to an outside of the developing container via an air discharge port that is open at a distal end of the air discharge duct; and a filtration portion that is disposed in the air discharge duct adjacently to the air discharge port and restricts leakage of the developer through the air discharge port, and the air discharge duct is formed at a bottom of the first stirring chamber.

2. The developing device according to claim 1, wherein the partition includes a partition wall that is provided on a downstream side of the communication portion with respect to the circulation direction and opposed to the reverse spiral vane.

3. The developing device according to claim 1, wherein the filtration portion includes a filter member that covers the air discharge port.

4. The developing device according to claim 3, wherein the filter member has an open cell structure.

5. The developing device according to claim 1, wherein the developer includes either one of the toner and a carrier that have magnetism, and the filtration portion uses a magnet disposed in a vicinity of the air discharge port to attract the developer so as to retain the developer in the air discharge duct and thus restricts leakage of the developer through the air discharge port.

6. An image forming apparatus comprising:

the developing device according to claim 1.

* * * * *